US006844900B2

(12) United States Patent
Yuen

(10) Patent No.: US 6,844,900 B2
(45) Date of Patent: Jan. 18, 2005

(54) METHOD AND SYSTEM FOR REVERSE UNIVERSAL REMOTE CONTROL FEATURE

(75) Inventor: Henry C. Yuen, Pasadena, CA (US)

(73) Assignee: Index Systems, Inc., Tortola (VG)

( * ) Notice: Subject to any disclaimer, the term of this patent is extended or adjusted under 35 U.S.C. 154(b) by 96 days.

(21) Appl. No.: 10/396,275

(22) Filed: Mar. 24, 2003

(65) Prior Publication Data

US 2003/0227407 A1 Dec. 11, 2003

Related U.S. Application Data

(60) Provisional application No. 60/366,979, filed on Mar. 22, 2002.

(51) Int. Cl.[7] ..... A04N 5/44

(52) U.S. Cl. ..... 348/734; 341/176; 341/825.69; 341/825.72; 455/151.2; 455/352

(58) Field of Search ..... 341/173, 176; 348/734; 340/825.69, 825.72; 455/151.2, 352

(56) References Cited

U.S. PATENT DOCUMENTS 4,529,980 A * 7/1985 Liotine et al. ..... 340/825.52
5,081,534 A * 1/1992 Geiger et al. ..... 348/734
5,148,159 A * 9/1992 Clark et al. ..... 340/825.22
5,291,193 A * 3/1994 Isobe et al. ..... 340/825.69
5,386,251 A * 1/1995 Movshovich ..... 348/734
6,008,736 A * 12/1999 Palm et al. ..... 340/825.22
6,198,408 B1 * 3/2001 Cohen ..... 340/825.69
RE37,986 E * 2/2003 Heitschel et al. ..... 700/90
6,529,556 B1 * 3/2003 Perdue et al. ..... 375/260
6,747,590 B1 * 6/2004 Weber ..... 341/176

* cited by examiner

*Primary Examiner*—Albert K. Wong
(74) *Attorney, Agent, or Firm*—Fish & Neave LLP; Cathy Ding

(57) ABSTRACT

A system for providing a universal remote control feature for consumer electronics devices includes an existing remote control for remotely controlling a first consumer electronics device using a first device control code and means for storing the first device control code and a second device control code within a second consumer electronics device. The system further includes means for converting the first device control code into the second device control code when using the existing remote control to control the second consumer electronics device.

13 Claims, 3 Drawing Sheets

METHOD AND SYSTEM FOR REVERSE UNIVERSAL REMOTE CONTROL FEATURE

CROSS REFERENCE TO RELATED APPLICATIONS

This application claims priority of Provisional U.S. patent application Ser. No. 60/366,979, filed Mar. 22, 2002, the content of which are incorporated herein by reference.

FIELD OF THE INVENTION

The present invention relates generally to the remote control operation of consumer electronic devices, and more particularly to a universal remote control feature that can be integrated into any consumer electronic device.

BACKGROUND OF THE INVENTION

Universal remote controls are generally well known devices that can be programmed by a user to operate one of a plurality of different types of consumer electronic devices produced by different manufacturers. A consumer electronic device typically has its own dedicated remote control that uses infrared signals to remotely control the operation of the device. The appropriate infrared signal is associated with a particular button or sequence of buttons on a keypad of the remote control. By depressing the button or buttons on the remote control, the user causes the remote control to transmit the corresponding infrared signal. The electronic device receives the infrared signal, processes its content, and performs a function associated with the infrared signal. However, since each consumer electronic device typically requires its own remote control with its own infrared (IR) signal structure, a user must keep track of a multitude of remote controls and recall which remote control operates which electronic device—all of which can be very cumbersome.

As a result of these and other disadvantages, universal remote controls are highly desired. Through a universal remote control, a user can consolidate several distinct control devices into a single control device for remotely controlling a variety of different types of consumer electronic devices from different manufacturers. There are generally two different methods for accomplishing this consolidation—preprogrammed or learning. Since each manufacturer uses a different signal structure for each dedicated remote control, a preprogrammed universal remote control has a large database or library of reference codes stored within the universal remote control.

The reference code identifies the specific type of consumer electronic device and its manufacturer and allows the universal remote control to transmit control signals having the proper signal structure to the device to be controlled. The proper signal structure may be determined by characteristics that include carrier frequency, pulse width, pulse modulation and overall timing. Reference codes may be manually entered into a universal remote control or a universal remote control may automatically search through the database of reference codes until the desired code is found.

Alternatively, a universal remote control can be programmed to "learn" the proper signal structure. This type of universal remote control requires a user to "teach" the universal remote control the desired functions of the dedicated remote control. Typically, this is accomplished by switching the universal remote control into a "learning mode," and physically orienting the two control units such that the universal remote control can receive the infrared transmissions from the dedicated remote control for the operations to be emulated.

Often, this learning process begins as an information storage process, wherein an infrared transmission from the dedicated remote control is stored (and possibly compressed) as it is being received by the universal remote control. When the universal remote control is subsequently used to transmit a command to a particular consumer electronics device, the appropriate stored signal code is recalled from the memory of the universal remote (and possibly uncompressed) and transmitted to the appropriate consumer electronic device.

Regardless of the particular type of universal remote control, the process of replacing a dedicated remote control with a universal remote control has its disadvantages. For example, a user may already be familiar with the form and functionality of a dedicated remote control and will have to learn an entirely new form and functionality associated with a new remote control. The new universal remote control may have different buttons, different layouts or combinations of both.

Additionally, the overall shape and design of the new universal remote control may be different from that of the existing dedicated remote control which the user has already invested time and energy into learning. As a result, it would be beneficial to allow users to still benefit from the advantages of a universal remote control feature without having to adopt an entirely new remote control unit.

SUMMARY OF THE INVENTION

In one aspect of the present invention method for providing a universal remote control feature includes identifying an existing remote control dedicated to controlling an existing consumer electronics device and a new consumer electronics device to be controlled by the existing remote control. Storing a plurality of device control codes within the new consumer electronics device, including an existing device control code associated with the existing consumer electronics device and a new device control code associated with the new consumer electronics device. Using the existing remote control device to control the new consumer electronics device by receiving the existing device control code from the existing remote control device and converting the existing device control code into the new device control code.

In another aspect of the present invention a system for providing a universal remote control feature includes a remote control unit, a first consumer electronics device controlled by the remote control unit, a second consumer electronics device to be controlled by the remote control unit. The system further includes a first device control code for controlling the first consumer electronics device and a second device control code for controlling the second consumer electronics device. In one embodiment the second consumer electronics device includes memory within for storing the first device control code and the second device control code and a controller operatively connected to the memory. In the described system the remote control unit is used to control the second consumer electronics device and the controller converts first device control code received from the remote control unit into a second device control code.

In a further aspect of the present invention a system for providing a universal remote control feature for consumer electronics devices includes a first consumer electronics device having a first device control code and a second consumer electronics device having a second device control code. The system further includes means for remotely controlling the first consumer electronics device and means for storing the first device control code and the second device control code within the second consumer electronics device. In this further aspect of the present invention the described system further includes means for converting the first device control code into the second device control code when using the remotely controlling means for controlling the second consumer electronics device.

BRIEF DESCRIPTION OF THE DRAWINGS

The present invention will become better understood with regard to the following description, appended claims, and accompanying drawings, in which:

DETAILED DESCRIPTION OF THE INVENTION

The present invention, therefore, provides a method and system for providing a universal remote control feature in any consumer electronics device that does not require a user to adopt a new remote control device in order to take advantage of the universal remote control feature. As a result, the user is able to continue using an existing remote control to control any existing or new consumer electronics devices that incorporate this universal remote control feature.

In an exemplary embodiment the universal remote control feature incorporated in the consumer electronics device includes any necessary hardware and software to translate or convert the control signals from the existing remote control to the appropriate control signals for the consumer electronics device. By incorporating the necessary hardware and software into the consumer electronics device itself, rather than into the remote control, any remote control can be used to take advantage of this universal remote feature.

Those skilled in the art should realize that one of the features of incorporating the necessary hardware and software into the consumer electronics device itself, rather than into the remote control, is that the consumer electronics device will likely have more robust hardware (e.g. processor and memory) than would typically be available in the remote control. Therefore, the incorporation of the universal remote control feature into the electronics device provides greater flexibility and performance than typically available in a universal remote control.

Figure 2:
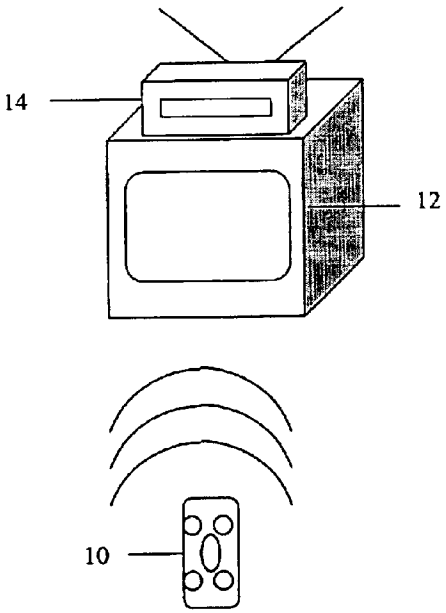
FIG. 2 is a simplified diagram of a consumer electronics system wherein an existing remote control controls an existing consumer electronics device and a new consumer electronics device in accordance with an exemplary embodiment of the present invention.
Figure 1:
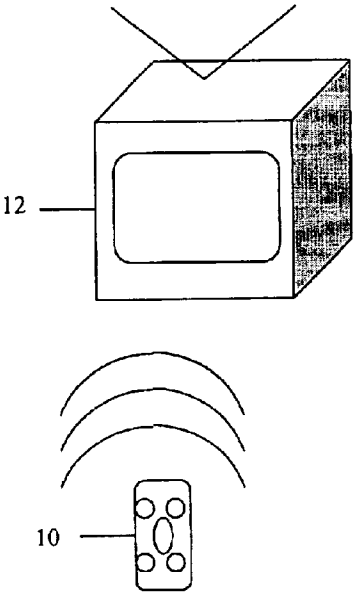
FIG. 1 is a simplified diagram of a consumer electronics system wherein an existing remote control controls an existing consumer electronics device.

These and other features and advantages of the present invention will be appreciated as the same become better understood when considered in connection with the following drawings. Referring now to FIG. 1, a user has an existing remote control 10 that is used to control an existing consumer electronics device 12. In the present example the existing consumer electronics device is, by way of example, a television (TV). In FIG. 2, the user has added a new consumer electronics device 14. In the present example, the new consumer electronics device is, by way of example, a set-top box (STB). If the user desired to use a single remote control for controlling both of the consumer electronics devices, and assuming that the existing remote control 10 is not already a universal remote control, it would typically be necessary to adopt a new universal remote control device.

However, this may not be desirable if the user is already familiar and comfortable with the existing remote control 10. As a result of the present invention, the user can continue to use the existing remote control 10 to control both of the consumer electronics devices, as well as any other consumer electronics device that incorporates the universal remote control feature described herein.

In order to provide the universal remote control feature described herein, the new consumer electronics device 14 will include any necessary hardware and software for translating or converting the control signals from the existing remote control 10 to the appropriate control signals for the new consumer electronics device 14. In an exemplary embodiment, the new electronics device includes memory for storing a database of applicable reference codes for different consumer electronics devices from different manufacturers (e.g. universal remote control code database). Using these reference codes, it is possible to determine the proper signal structure for control signals for any device in the database.

Therefore, the described exemplary new consumer electronics device can receive the infrared control signals from the existing remote control and covert those control signals into the appropriate control signals for the new consumer electronics device using the stored codes for the existing remote control. The described exemplary new consumer electronics device can then control the new consumer electronics device in accordance with the converted control codes.

In addition, in an exemplary embodiment the new consumer electronics device 14 may also include the ability to "learn" the proper signal structure of an existing remote control 10 whose control signal structure is not already in the database. For example, in an exemplary embodiment the new consumer electronics device includes a "learning mode" that may process and store codes for an existing remote control. The learning process begins by switching the new consumer electronics device to the "learning mode", and physically orienting the existing remote control such that the new consumer electronics device can receive the transmissions (i.e. IR, RF, hardwired or the like) of the existing remote control to be emulated.

In the described exemplary embodiment, the user may then be instructed to walk through a series of operations on the existing remote control, i.e. to push specific buttons and/or sequences of buttons. In an exemplary embodiment, the new consumer electronics device receives the transmissions from the existing remote control and stores the corresponding control signal information within the memory of the new consumer electronics device. In one embodiment a processor may analyze and compress the data received from the existing remote control and the final compressed version of the control signals for the existing remote control may then be stored.

As a result, the new consumer electronics device can receive the infrared control signals from the existing remote control, covert those control signals into the appropriate control signals for new consumer electronics device using the stored control signals, and control the new consumer electronics device accordingly.

Figure 3:
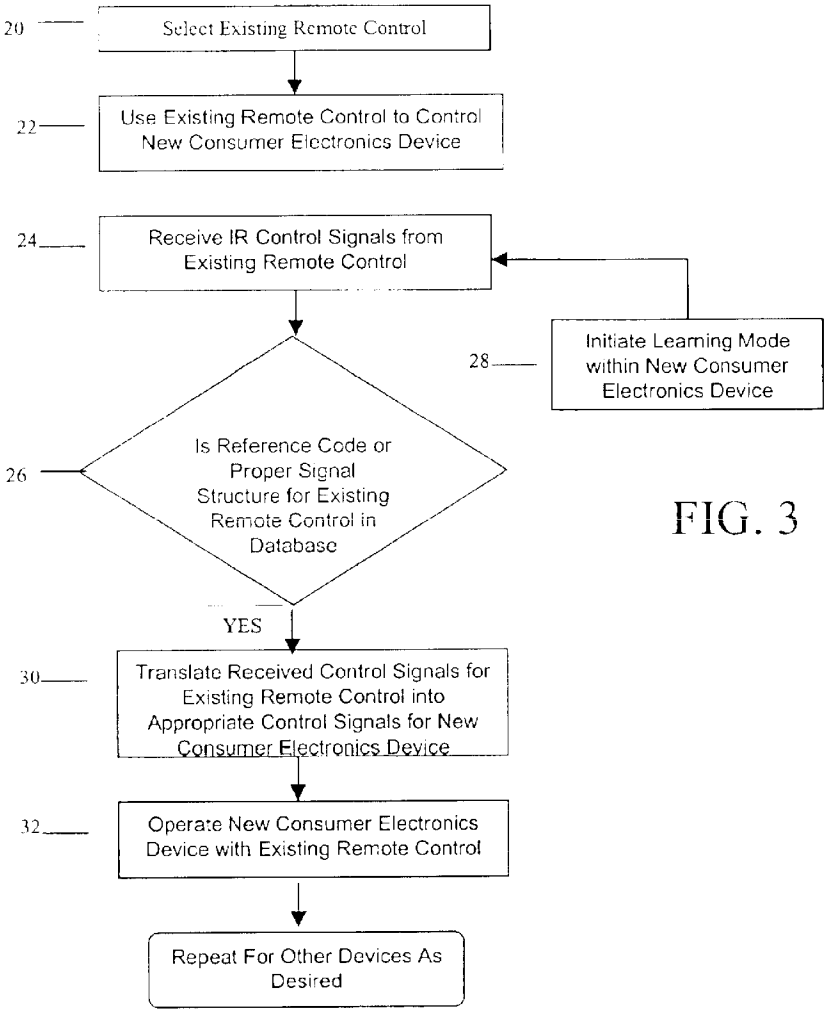
FIG. 3 is a flow chart graphically illustrating the operation of the consumer electronics system of FIG. 2 in accordance with an exemplary embodiment of the present invention.

Turning now to FIG. 3, an exemplary process embodied in the present invention is illustrated in flowchart form. In step 20, the user identifies an existing remote control that he or she wants to use to control one or more consumer electronics devices. In step 22, the user begins to use the existing remote control to control a new consumer electronics device. The new consumer electronics device receives (24) the infrared control signals from the existing remote control and access its memory to determine (26) if the appropriate reference code and corresponding control signal structure for the existing remote control has been preprogrammed into the new consumer electronics device.

For example, an exemplary STB may prompt the user through the process via a set-up menu or on-screen instructions displayed on the TV. The user may be prompted to select or identify a consumer electronics device and manufacturer for the existing remote control TV, either from an on-screen list generated by the STB or from a printed list of codes that accompanies the STB or is otherwise generally available.

If the appropriate reference code is already stored within the memory of the STB, the STB will identify the corresponding control signal structure and may prompt the user to test the existing remote control to confirm that the proper control signal structure has been selected so that the existing remote can control the STB.

If the appropriate reference code and corresponding control signals for the existing remote control are not already stored within the new consumer electronics device, the new consumer electronics device may switch to a learning mode (28) where it attempts to learn the proper signal structure for the existing remote control. The control signal structure for the existing remote control is then stored in the memory of the new consumer electronics device.

For example, an exemplary STB may again prompt the user through the process via a set-up menu or on-screen instructions displayed on the TV. Specifically, in an exemplary embodiment the user will, by way of example, be prompted to select or depress one button at a time on the existing remote control until the control signal structure for all of the desired buttons or sequences of buttons has been digitized and stored in a databases within the STB.

Figure 4:
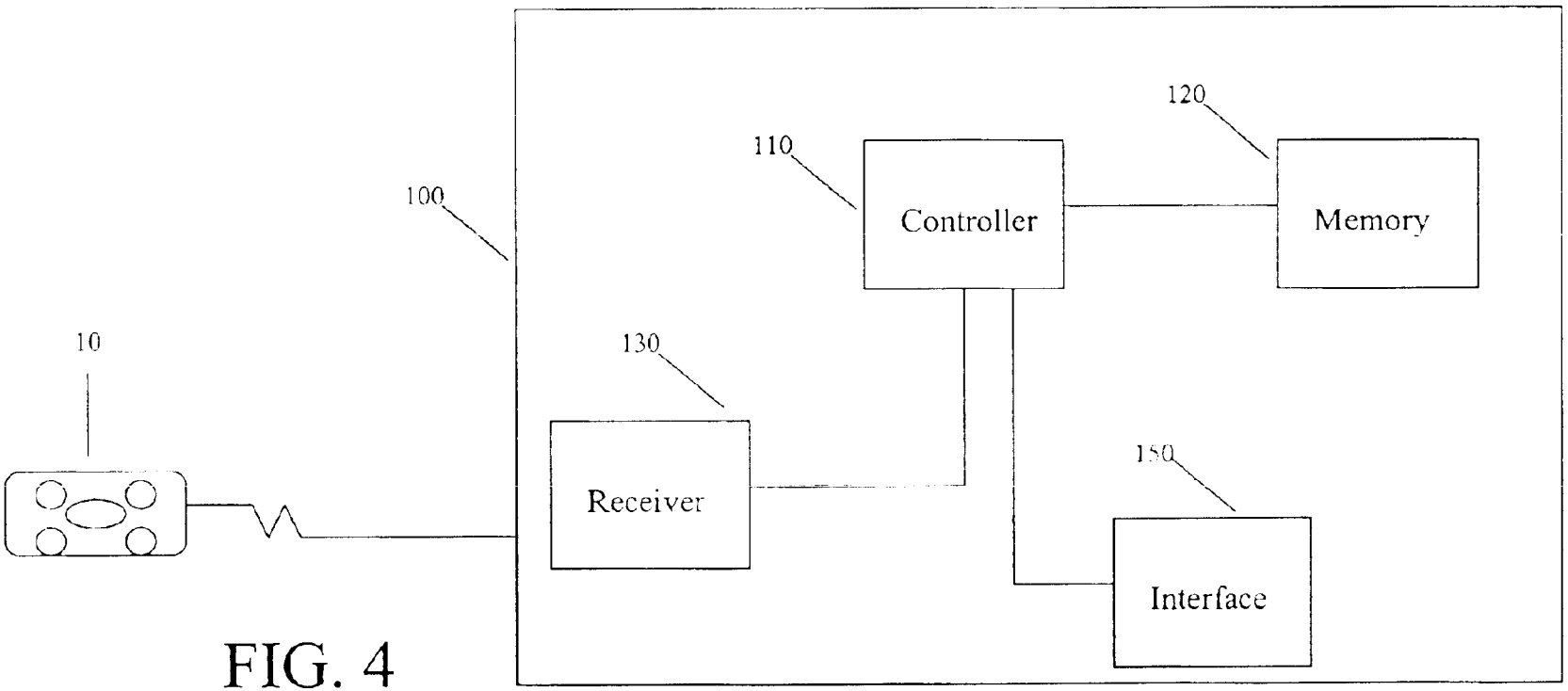
FIG. 4 is a simplified block diagram of a receiver module of the new consumer electronics device of FIG. 2 in accordance with an exemplary embodiment of the present invention.

The database of digitized control signals and the corresponding assigned function will be stored in the memory of the STB for future reference when the existing remote control is subsequently used to control the STB. In step 30, the new consumer electronics device receives the control signals from the existing remote control, converts those control signals into the appropriate control signals for the new consumer electronics device, and controls (32) the new consumer electronics device accordingly. The same process can be repeated for any number of different consumer electronics devices incorporating the present invention so that the existing remote control can be used as a single point of control for all devices FIG. 4 illustrates a simplified schematic of a receiver module 100 in a consumer electronics device comprising a controller 110 or microprocessor, a memory such as for example a random access memory (RAM) 120 that stores the device control codes for the new electronics device, and a receiver 130 that is capable of receiving control signals having different types of signal structures. For example, the transmission of IR signals may either be pulsed or modulated at a specific frequency (e.g. 40 kHz, 50 kHz, or the like). As a result, the IR receiver or receiving module of the new consumer electronics device may need to be able to receive pulsed IR signals, IR signals modulated at 40 kHz, and IR signals modulated at 50 kHz.

Traditionally, IR receivers and receiving modules in consumer electronics are narrow-band devices that receive the appropriate IR signals and use filters to remove unwanted IR signals. Wideband receivers are generally not desirable in many applications, as they are unable to filter out unwanted or undesirable IR signals or noise. In an exemplary embodiment, the IR receiver of the new consumer electronics device comprises multiple narrow-band receivers, each of which has different filters. The IR receiving module would be programmed to automatically select between the different receivers. Alternatively, the IR receiver may comprise a wideband receiver with a dynamically configurable filter. In the described exemplary embodiment the filter is, by way of example, programmed to automatically configure its pass bands, stop bands, etc. as needed.

In one embodiment, the new consumer electronics device may further include an interface 150 for accessing control data stored on a removable storage media such as a floppy disk, smart card, or the like. The new consumer electronics device may further include, by way of example, a communication port, such as a telephone jack or cable interface for receiving control code information from a remote source.

When in the learning mode receiver 130 receives, by way of example, IR signals transmitted by the existing remote control, and provides digital data representative of those IR signals to controller 110. The controller 110 extracts the format of the signal structure representing the transmitted data and stores it in RAM 120.

In operation, the receiver 130 of the new consumer electronics device receives IR codes sent from the existing remote control 10 and forwards them to the controller 110 for analysis. The controller extracts the format of the signal structure and compares it to the data stored in RAM to determine the command transmitted by the existing remote control. The controller may then correlate the command with a corresponding device control code for the new electronics device and control the new electronics device accordingly.

While various embodiments of this invention have been shown and described, it would be apparent to those skilled in the art that many more modifications are possible without departing from the inventive concepts herein. For example, although the present invention is described and illustrated using a television and set-top box, any other consumer electronics device may be used. For example, the consumer electronics device may be a VCR, DVD, HDD, PVR, stereo, etc., or any combination of these and other similar devices.

Additionally, those skilled in the art and technology would realize that any other conventional features of a universal remote control that are typically incorporated into the remote itself may alternatively be incorporated into the consumer electronics device under the present invention. Furthermore, the new consumer electronics device may be a two-way device that is operatively connected to a centralized server or network and can communicate with that server (e.g. through a modem).

As a result, the new consumer electronics device communicate to the server when appropriate reference code or corresponding control signals for the existing remote control are not stored within the database. These new reference codes can then be added to subsequent releases of the database to improve the utility of the present invention. It is, therefore, to be understood that within the scope of the appended claims, this invention may be practiced otherwise than as specifically described.

What is claimed is:

1. A method for providing a universal remote control feature, the method comprising the steps of:

identifying an existing remote control dedicated to controlling an existing consumer electronics device;

identifying a new consumer electronics device to be controlled by the existing remote control;

storing a plurality of device control codes within the new consumer electronics device, including an existing device control code associated with the existing consumer electronics device and a new device control code associated with the new consumer electronics device;

using the existing remote control device to control the new consumer electronics device by receiving the existing device control code from the existing remote control device and converting the existing device control code into the new device control code.

2. The method of claim 1 further comprising the steps of:

identifying a second new consumer electronics device to be controlled by the existing remote control; and teaching the second new consumer electronics device to convert the existing device control code from the existing remote control into a second new device control code for controlling the second new consumer electronics device.

3. A system for providing a universal remote control feature, the system comprising:

a remote control unit;

a first consumer electronics device and controlled by the remote control unit;

a second consumer electronics device to be controlled by the remote control unit;

a first device control code for controlling the first consumer electronics device;

a second device control code for controlling the second consumer electronics device;

a memory within the second consumer electronics device for storing the first device control code and the second device control code;

a controller operatively connected to the memory; and wherein, when the remote control unit is used to control the second consumer electronics device, the controller converts the first device control code into a second device control code.

4. The system of claim 3 further comprising:

a third consumer electronics device to be controlled by the remote control unit; and a third device control code for controlling the third consumer electronics device;

wherein, when the remote control unit is used to control the third consumer electronics device, the controller is taught how to convert the first device control code into the third device control code.

5. A system for providing a universal remote control feature for consumer electronics devices, the system comprising:

a first consumer electronics device having a first device control code;

a second consumer electronics device having a second device control code;

means for remotely controlling the first consumer electronics device;

means for storing the first device control code and the second device control code within the second consumer electronics device;

means for converting the first device control code into the second device control code when using the remotely controlling means for controlling the second consumer electronics device.

6. The system of claim 5 further comprising:

a third consumer electronics device having a third device control code; and means for teaching the third consumer electronics device to convert the first device control code into the third device control code for controlling the third consumer electronics device with the remotely controlling means.

7. A method for providing a universal remote control feature comprising:

storing a plurality of device control codes within a new consumer electronics device, including a control code for an existing remote control and a new device control code associated with the new consumer electronics device; and receiving existing device control code commands from the existing remote control device and converting the existing device control code commands into new device control code commands.

8. The method of claim 7 further comprising teaching a second new consumer electronics device to convert the existing device control code from the existing remote control into a second new device control code for controlling the second new consumer electronics device.

9. The method of claim 8 wherein teaching a second new consumer electronics device to convert the existing device control code from the existing remote control into a second new device control code comprises receiving existing device control codes transmitted by the existing remote control device and storing the received existing device control codes.

10. The method of claim 9 wherein teaching a second new consumer electronics device to convert the existing device control code from the existing remote control into a second new device control code further comprises analyzing characteristics of the received existing device control codes to determine signal structure of the existing device control codes.

11. The method of claim 10 wherein determining signal structure of the received existing device control codes comprises determining at least one of carrier frequency, pulse width and pulse modulation of the received existing device control codes.

12. A system for providing a universal remote control feature for consumer electronics devices, the system comprising:

an existing remote control for remotely controlling a first consumer electronics device using a first device control code;

means for storing the first device control code and a second device control code within a second consumer electronics device; and means for converting the first device control code into the second device control code when using the existing remote control for controlling the second consumer electronics device.

13. The system of claim 12 further comprising a third consumer electronics device having a third device control code means for teaching the third consumer electronics device to convert the first device control code into the third device control code for controlling the third consumer electronics device with the existing remote control.

* * * * *